US010368636B1

(12) United States Patent
Hearn

(10) Patent No.: US 10,368,636 B1
(45) Date of Patent: Aug. 6, 2019

(54) ILLUMINATED TABLE

(71) Applicant: Robert J. Hearn, Farmington Hills, MI (US)

(72) Inventor: Robert J. Hearn, Farmington Hills, MI (US)

( * ) Notice: Subject to any disclaimer, the term of this patent is extended or adjusted under 35 U.S.C. 154(b) by 0 days.

(21) Appl. No.: 15/961,983

(22) Filed: Apr. 25, 2018

(51) Int. Cl.

| | |
|---|---|
| ***F21S 6/00*** | (2006.01) |
| ***A47B 13/00*** | (2006.01) |
| ***A47B 13/02*** | (2006.01) |
| ***A47B 13/12*** | (2006.01) |

(52) U.S. Cl.
CPC ..... *A47B 13/12* (2013.01); *A47B 13/023* (2013.01); *A47B 2013/006* (2013.01); *A47B 2220/0075* (2013.01); *F21S 6/002* (2013.01)

(58) Field of Classification Search
CPC ..... A47B 13/12; A47B 13/023; A47B 13/003; A47B 13/083; A47B 2013/125; A47B 2013/006; A47B 2013/085; A47B 2200/0075; F25S 6/002
See application file for complete search history.

(56) References Cited

U.S. PATENT DOCUMENTS

| | | | | | |
|---|---|---|---|---|---|
| 2,428,735 | A | | 10/1947 | Brandom | |
| 3,624,381 | A | * | 11/1971 | Pollack | F21S 6/002 108/23 |
| 3,689,762 | A | | 9/1972 | Shatan | |
| 4,091,706 | A | | 5/1978 | Ludwig | |
| 4,450,774 | A | * | 5/1984 | Weaver | A47B 11/00 108/104 |
| 4,876,969 | A | * | 10/1989 | Infanti | A47B 31/00 108/24 |
| 5,816,171 | A | * | 10/1998 | Fitts, Jr. | A47B 13/12 108/23 |
| 5,911,496 | A | * | 6/1999 | Hojnacki | A47B 3/12 108/23 |
| 6,464,371 | B2 | * | 10/2002 | Bender | A47B 13/12 362/127 |
| 6,991,231 | B1 | * | 1/2006 | Tien | A63F 9/00 273/108.1 |
| D662,727 | S | | 7/2012 | Cooper et al. | |
| 8,684,552 | B2 | | 4/2014 | de Blois | |
| 9,612,006 | B2 | * | 4/2017 | Powell | F21V 33/0012 |
| 2004/0004838 | A1 | * | 1/2004 | Cheng | F21S 6/002 362/249.06 |
| 2012/0227638 | A1 | * | 9/2012 | Boda | A47B 13/12 108/28 |
| 2013/0172663 | A1 | * | 7/2013 | Leonard | A61M 21/02 600/27 |
| 2015/0033606 | A1 | * | 2/2015 | Dinlocker | A47G 1/14 40/727 |

(Continued)

*Primary Examiner* — Daniel J Rohrhoff

(57) ABSTRACT

An illuminated table for providing illumination proximate to the table includes a housing that defines an interior space. The housing is substantially transparent. An orifice is centrally positioned through an upper end of the housing. The orifice defines an inner lip that extends annularly around a circumference of the upper end. A plurality of bulbs is selectively couplable to the housing and is positionable in the interior space. A plurality of first plates is selectively couplable to the housing to close the orifice. A respective first plate is positionable on the housing to serve as a tabletop. The plurality of bulbs is configured to illuminate an area proximate to the housing.

18 Claims, 4 Drawing Sheets

(56) References Cited

U.S. PATENT DOCUMENTS

2015/0300627 A1* 10/2015 Wang ..... F21V 33/0012
108/23
2017/0360191 A1* 12/2017 Jaramillo ..... A47B 13/083

* cited by examiner

ILLUMINATED TABLE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to tables and more particularly pertains to a new table for providing illumination proximate to the table.

BRIEF SUMMARY OF THE INVENTION

An embodiment of the disclosure meets the needs presented above by generally comprising a housing that defines an interior space. The housing is substantially transparent. An orifice is centrally positioned through an upper end of the housing. The orifice defines an inner lip that extends annularly around a circumference of the upper end. A plurality of bulbs is selectively couplable to the housing and is positionable in the interior space. A plurality of first plates is selectively couplable to the housing to close the orifice. A respective first plate is positionable on the housing to serve as a tabletop. The plurality of bulbs is configured to illuminate an area proximate to the housing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
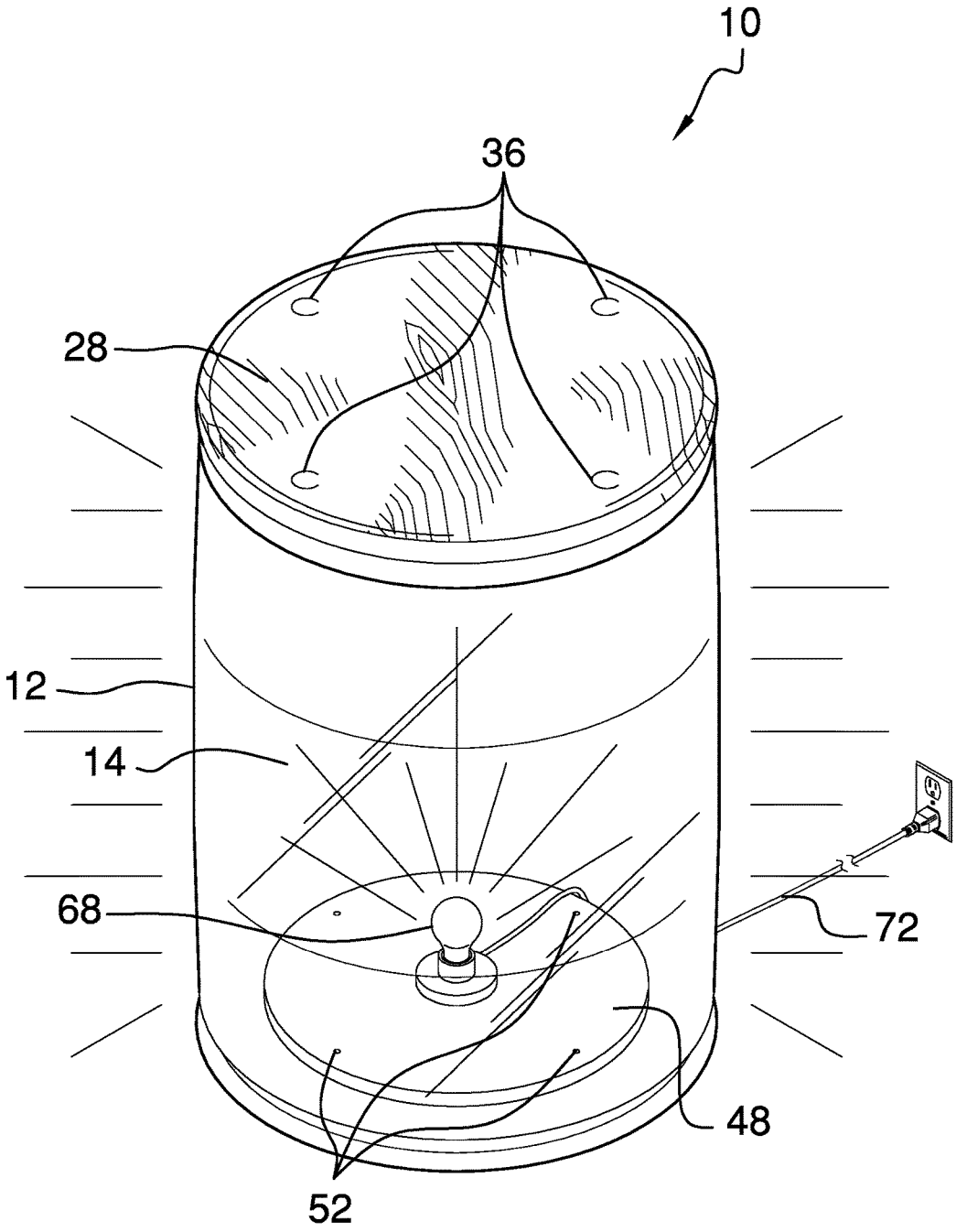
FIG. 1 is an isometric perspective view of an illuminated table according to an embodiment of the disclosure.

With reference now to the drawings, and in particular to FIGS. 1 through 5 thereof, a new table embodying the principles and concepts of an embodiment of the disclosure and generally designated by the reference numeral 10 will be described.

As best illustrated in FIGS. 1 through 5, the illuminated table 10 generally comprises a housing 12 that defines an interior space 14. The housing 12 is substantially transparent. The housing 12 comprises a wall 16 that extends between an upper end 18 and a lower end 20 of the housing 12. The wall 16 is substantially transparent. The upper end 18 and the lower end 20 are circularly shaped so that the housing 12 is cylindrically shaped.

Figure 4:
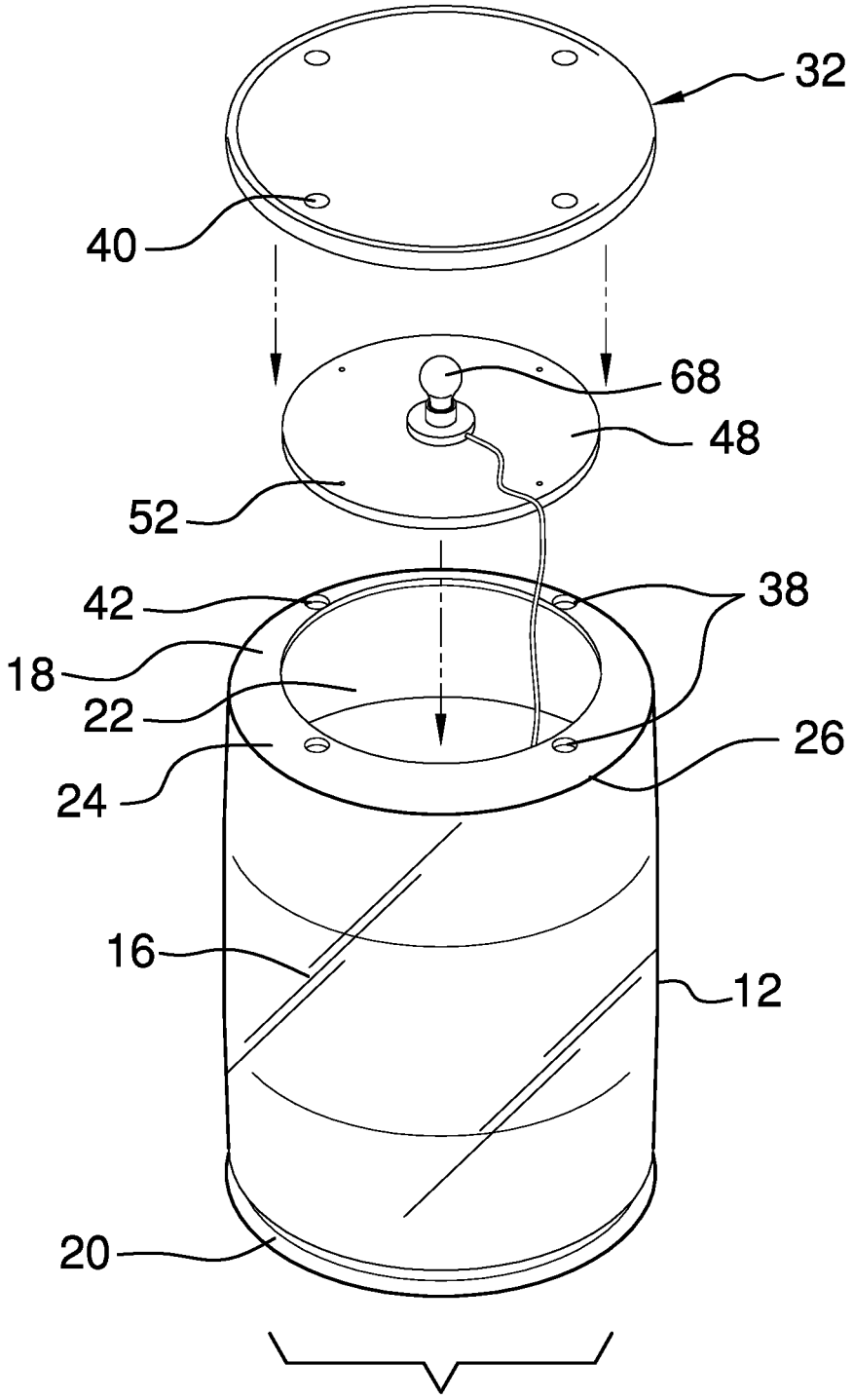
FIG. 4 is an exploded view of an embodiment of the disclosure.
Figure 5:
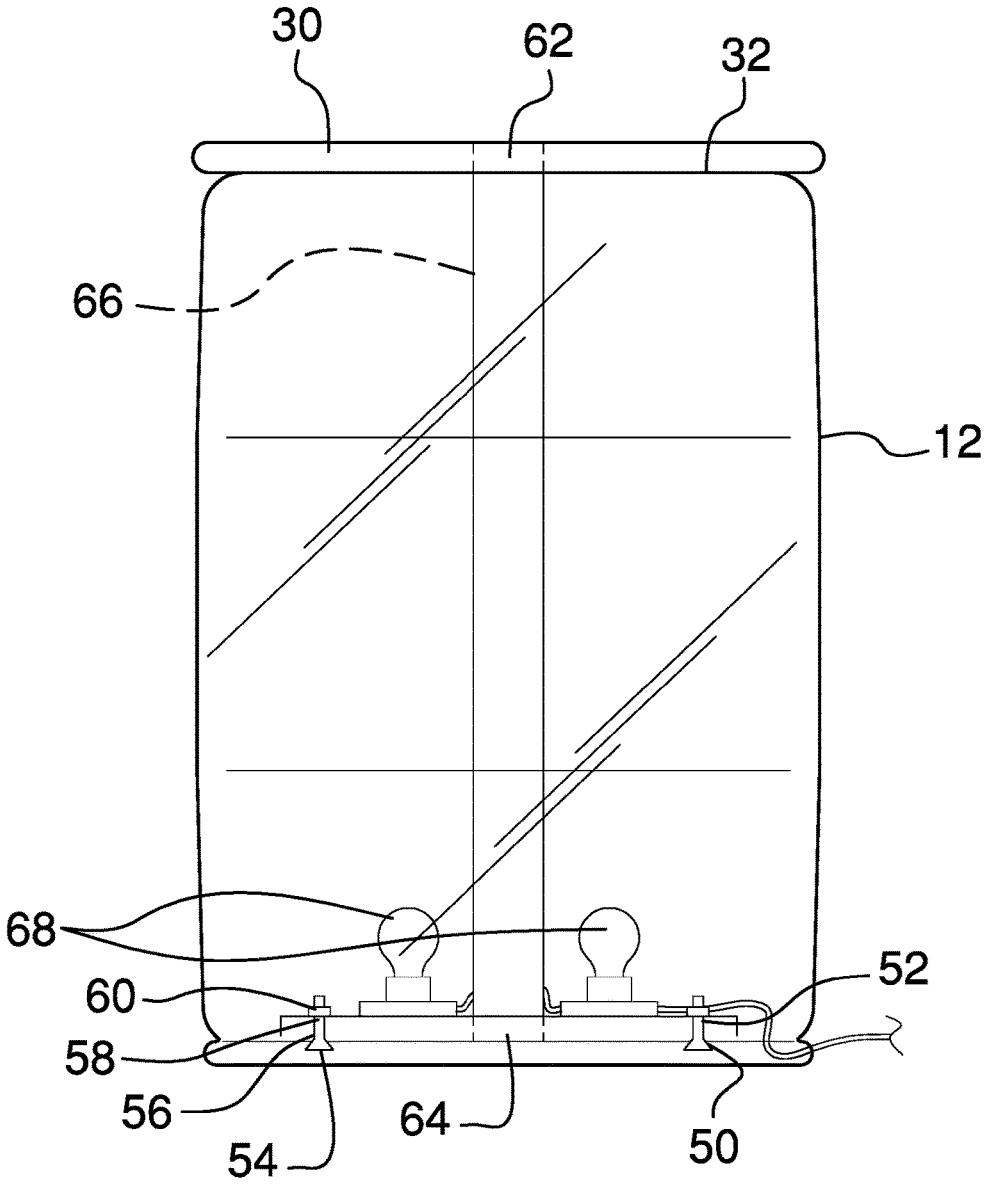
FIG. 5 is a front view of an embodiment of the disclosure.

An orifice 22 is centrally positioned through the upper end 18 of the housing 12. The orifice 22 defines an inner lip 24 that extends annularly around a circumference 26 of the upper end 18, as shown in FIG. 4. The orifice 22 is circularly shaped.

Figure 3:
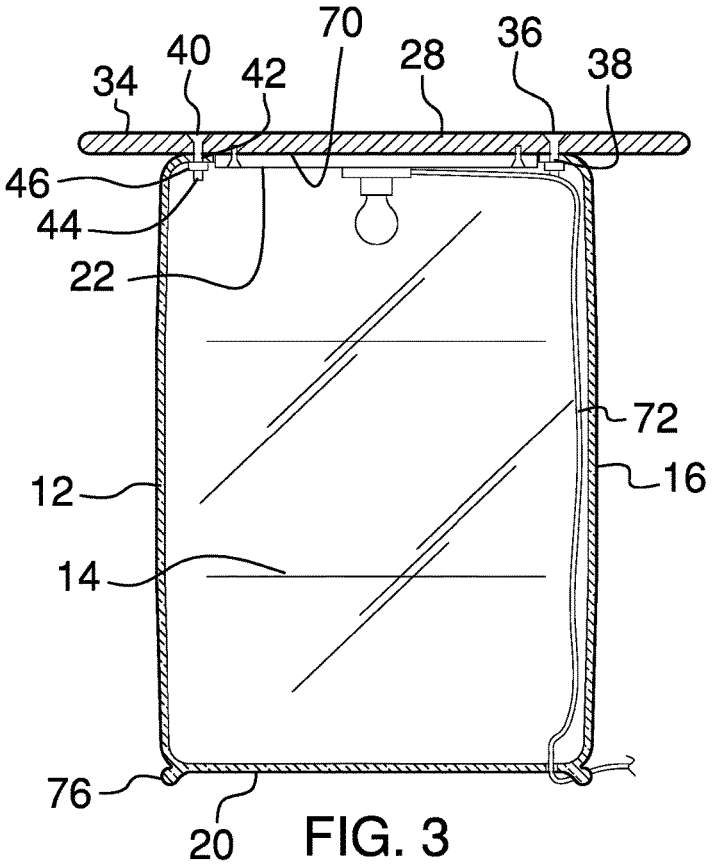
FIG. 3 is a cross-sectional view of an embodiment of the disclosure.

A plurality of first plates 28 is selectively couplable to the housing 12 to close the orifice 22. A respective first plate 28 is positionable on the housing 12 to serve as a tabletop 30. In one embodiment of the invention, the plurality of first plates 28 comprises a first top 32 and a second top 34. The first top 32 is substantially complementary to the upper end 18 of the housing 12, as shown in FIG. 1. The second top 34 is circumferentially larger than the upper end 18 so that the second top 34 extends perpendicularly from the wall 16, as shown in FIG. 3.

Each of a plurality of sets of first couplers 36 is coupled to a respective first plate 28. Each set of first couplers 36 comprises four first couplers 36. A plurality of second couplers 38 is coupled to the inner lip 24. The second couplers 38 are complementary to the first couplers 36. The second couplers 38 are positioned to selectively couple to a respective set of first couplers 36 to couple an associated first plate 28 to the housing 12.

Each first coupler 36 comprises a first hole 40 and each second coupler 38 comprises a second hole 42. Each second hole 42 is positioned to align with a respective first hole 40. The second hole 42 and the respective first hole 40 are positioned to insert a first bolt 44 to position the first bolt 44 to threadedly couple to a first nut 46 to couple the associated first plate 28 to the housing 12. Each first hole 40 is countersunk so that the first bolt 44 is flush mounted.

The table 10 comprises a second plate 48 that is circumferentially smaller than the orifice 22. The orifice 22 is positioned to insert the second plate 48 to position the second plate 48 on the lower end 20 of the housing 12.

A plurality of third couplers 50 is positioned in the interior space 14 and is coupled to the lower end 20 of the housing 12. The plurality third couplers 50 comprises four third couplers 50. A plurality of fourth couplers 52 is coupled to the second plate 48. The fourth couplers 52 are complementary to the third couplers 50. Each fourth coupler 52 is positioned to selectively couple to a respective third coupler 50 to couple the second plate 48 to the housing 12.

Each third coupler 50 comprises a third hole 54 and each fourth coupler 52 comprises a fourth hole 56. Each fourth hole 56 is positioned to align with a respective third hole 54. The fourth hole 56 and the respective third hole 54 are positioned to insert a second bolt 58 to position the second bolt 58 to threadedly couple to a second nut 60 to couple the associated second plate 48 to the housing 12. Each third hole 54 is countersunk so that the second bolt 58 is flush mounted.

Each of a plurality of first apertures 62 is centrally positioned through a respective first plate 28. A second aperture 64 is centrally positioned in the second plate 48. The second aperture 64 is aligned with a respective first aperture 62 when an associated first plate 28 is coupled to the inner lip 24. A pipe 66 is selectively insertable through the respective first aperture 62 into the second aperture 64 so that the pipe 66 is fixedly positioned within the interior space 14. The pipe 66 is configured to insert a post of an umbrella to support the umbrella above the associated first plate 28.

A plurality of bulbs 68 is selectively couplable to the housing 12 and positionable in the interior space 14. The plurality of bulbs 68 is configured to illuminate an area proximate to the housing 12. The plurality of bulbs 68 is coupled to an underside 70 of an associated first plate 28, as shown in FIG. 3. In another embodiment, the plurality of bulbs 68 is coupled to the second plate 48, as shown in FIG. 1.

A cord 72 is operationally coupled to the plurality of bulbs 68. The cord 72 extends from the plurality of bulbs 68 through a fifth hole 74 that is positioned through the lower end 20 of the housing 12. The cord 72 is configured to selectively couple the plurality of bulbs 68 to a source of alternating current. The cord 72 is configured to supply power to the plurality of bulbs 68 to illuminate the area proximate to the housing 12.

Figure 2:
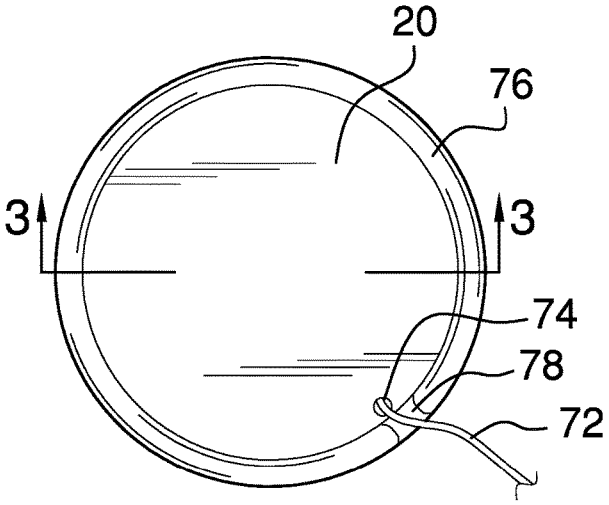
FIG. 2 is a bottom view of an embodiment of the disclosure.

A rim 76 is coupled to and extends from the lower end 20 of the housing 12. A notch 78 is positioned in the rim 76 proximate to the fifth hole 74, as shown in FIG. 2. The notch 78 is positioned to insert the cord 72 to prevent pinching of the cord 72 between the rim 76 and a surface upon which the housing 12 is positioned.

In use, a first plate 28 is positioned on the upper end 18 of the housing 12 and coupled to the inner lip 24 so that the first plate 28 is configured to serve as a tabletop 30. The plurality of bulbs 68 that is positioned in the interior space 14 is configured to illuminate the area proximate to the housing 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An illuminated table comprising:

a housing defining an interior space, said housing being substantially transparent;

an orifice centrally positioned through an upper end of said housing defining an inner lip extending annularly around a circumference of said upper end;

a plurality of first plates selectively couplable to said housing for closing said orifice;

a plurality of bulbs selectively couplable to said housing and positionable in said interior space;

wherein a respective said first plate is positionable on said housing such that said respective said first plate is configured for serving as a tabletop, wherein said plurality of bulbs is positioned on said housing such that said plurality of bulbs is configured for illuminating an area proximate to said housing;

a second plate circumferentially smaller than said orifice such that said orifice is positioned for inserting said second plate for positioning said second plate on said lower end of said housing; and said plurality of bulbs being coupled to said second plate.

2. The table of claim 1, further including said housing comprising a wall extending between said upper end and a lower end of said housing, said wall being substantially transparent, said upper end and said lower end being circularly shaped such that said housing is cylindrically shaped.

3. The table of claim 2, further including said orifice being circularly shaped.

4. The table of claim 1, further including said plurality of bulbs being coupled to an underside of an associated said first plate.

5. The table of claim 1, further comprising:

a plurality of third couplers positioned in said interior space and coupled to said lower end of said housing;

a plurality of fourth couplers coupled to said second plate, said fourth couplers being complementary to said third couplers; and wherein said fourth couplers are positioned on said second plate such that each said fourth coupler is positioned for selectively coupling to a respective said third coupler for coupling said second plate to said housing.

6. The table of claim 5, further including said plurality third couplers comprising four said third couplers.

7. The table of claim 6, further including each said third coupler comprising a third hole, each said fourth coupler comprising a fourth hole, wherein said fourth holes are positioned in said second plate such that each said fourth hole is positioned for aligning with a respective said third hole such that said fourth hole and said respective said third hole are positioned for inserting a second bolt positioning said second bolt for threadedly coupling to a second nut for coupling said associated said second plate to said housing.

8. The table of claim 7, further including each said third hole being countersunk such that said second bolt is flush mounted.

9. The table of claim 5, further comprising:

a plurality of first apertures, each said first aperture being centrally positioned through a respective said first plate;

a second aperture centrally positioned in said second plate such that said second aperture is aligned with a respective said first aperture when an associated said first plate is coupled to said inner lip;

a pipe selectively insertable through said respective said first aperture into said second aperture such that said pipe is fixedly positioned within said interior space; and wherein said pipe is positioned in said interior space such that said pipe is configured for inserting a post of an umbrella for supporting the umbrella above said associated said first plate.

10. The table of claim 1, further including a cord operationally coupled to said plurality of bulbs, said cord extending from said plurality of bulbs through a fifth hole positioned through a lower end of said housing, said cord being configured for selectively coupling said plurality of bulbs to a source of alternating current such that said cord is configured for supplying power to said plurality of bulbs for illuminating the area proximate to said housing.

11. The table of claim 10, further including a rim coupled to and extending from said lower end of said housing.

12. The table of claim 11, further including a notch positioned in said rim proximate to said fifth hole, wherein said notch is positioned in said rim such that said notch is positioned for inserting said cord for preventing pinching of said cord between said rim and a surface upon which said housing is positioned.

13. An illuminated table comprising:

a housing defining an interior space, said housing being substantially transparent, said housing comprising a wall extending between said upper end and a lower end of said housing, said wall being substantially transparent, said upper end and said lower end being circularly shaped such that said housing is cylindrically shaped;

an orifice centrally positioned through an upper end of said housing defining an inner lip extending annularly around a circumference of said upper end;

a plurality of first plates selectively couplable to said housing for closing said orifice, said plurality of first plates comprising a first top and a second top, said first top being substantially complementary to said upper end of said housing, said second top being circumferentially larger than said upper end such that said second top extends perpendicularly from said wall;

a plurality of bulbs selectively couplable to said housing and positionable in said interior space;

wherein a respective said first plate is positionable on said housing such that said respective said first plate is configured for serving as a tabletop, wherein said plurality of bulbs is positioned on said housing such that said plurality of bulbs is configured for illuminating an area proximate to said housing.

14. The table of claim 13, further comprising:

a plurality of sets of first couplers, each said set of first couplers being coupled to a respective said first plate;

a plurality of second couplers coupled to said inner lip, said second couplers being complementary to said first couplers; and wherein said second couplers are positioned on said inner lip such that said second couplers are positioned for selectively coupling to a respective said set of first couplers for coupling an associated said first plate to said housing.

15. The table of claim 14, further including each said set of first couplers comprising four said first couplers.

16. The table of claim 14, further including each said first coupler comprising a first hole, each said second coupler comprising a second hole, wherein said second holes are positioned in said inner lip such that each said second hole is positioned for aligning with a respective said first hole such that said second hole and said respective said first hole are positioned for inserting a first bolt positioning said first bolt for threadedly coupling to a first nut for coupling said associated said first plate to said housing.

17. The table of claim 16, further including each said first hole being countersunk such that said first bolt is flush mounted.

18. An illuminated table comprising:

a housing defining an interior space, said housing being substantially transparent, said housing comprising a wall extending between an upper end and a lower end of said housing, said wall being substantially transparent, said upper end and said lower end being circularly shaped such that said housing is cylindrically shaped;

an orifice centrally positioned through said upper end of said housing defining an inner lip extending annularly around a circumference of said upper end, said orifice being circularly shaped;

a plurality of first plates selectively couplable to said housing for closing said orifice, wherein a respective said first plate is positionable on said housing such that said respective said first plate is configured for serving as a tabletop, said plurality of first plates comprising a first top and a second top, said first top being substantially complementary to said upper end of said housing, said second top being circumferentially larger than said upper end such that said second top extends perpendicularly from said wall;

a plurality of sets of first couplers, each said set of first couplers being coupled to a respective said first plate, each said set of first couplers comprising four said first couplers;

a plurality of second couplers coupled to said inner lip, said second couplers being complementary to said first couplers, wherein said second couplers are positioned on said inner lip such that said second couplers are positioned for selectively coupling to a respective said set of first couplers for coupling an associated said first plate to said housing, each said first coupler comprising a first hole, each said second coupler comprising a second hole, wherein said second holes are positioned in said inner lip such that each said second hole is positioned for aligning with a respective said first hole such that said second hole and said respective said first hole are positioned for inserting a first bolt positioning said first bolt for threadedly coupling to a first nut for coupling said associated said first plate to said housing, each said first hole being countersunk such that said first bolt is flush mounted;

a second plate circumferentially smaller than said orifice such that said orifice is positioned for inserting said second plate for positioning said second plate on said lower end of said housing;

a plurality of third couplers positioned in said interior space and coupled to said lower end of said housing, said plurality third couplers comprising four said third couplers;

a plurality of fourth couplers coupled to said second plate, said fourth couplers being complementary to said third couplers, wherein said fourth couplers are positioned on said second plate such that each said fourth coupler is positioned for selectively coupling to a respective said third coupler for coupling said second plate to said housing, each said third coupler comprising a third hole, each said fourth coupler comprising a fourth hole, wherein said fourth holes are positioned in said second plate such that each said fourth hole is positioned for aligning with a respective said third hole such that said fourth hole and said respective said third hole are positioned for inserting a second bolt positioning said second bolt for threadedly coupling to a second nut for coupling said associated said second plate to said housing, each said third hole being countersunk such that said second bolt is flush mounted;

a plurality of first apertures, each said first aperture being centrally positioned through a respective said first plate;

a second aperture centrally positioned in said second plate such that said second aperture is aligned with a respective said first aperture when an associated said first plate is coupled to said inner lip;

a pipe selectively insertable through said respective said first aperture into said second aperture such that said pipe is fixedly positioned within said interior space, wherein said pipe is positioned in said interior space such that said pipe is configured for inserting a post of an umbrella for supporting the umbrella above said associated said first plate;

a plurality of bulbs selectively couplable to said housing and positionable in said interior space, wherein said plurality of bulbs is positioned on said housing such that said plurality of bulbs is configured for illuminating an area proximate to said housing, said plurality of bulbs being coupled to an underside of an associated said first plate;

said plurality of bulbs being coupled to said second plate;

a cord operationally coupled to said plurality of bulbs, said cord extending from said plurality of bulbs through a fifth hole positioned through said lower end of said housing, said cord being configured for selectively coupling said plurality of bulbs to a source of alternating current such that said cord is configured for supplying power to said plurality of bulbs for illuminating the area proximate to said housing;

a rim coupled to and extending from said lower end of said housing;

a notch positioned in said rim proximate to said fifth hole, wherein said notch is positioned in said rim such that said notch is positioned for inserting said cord for preventing pinching of said cord between said rim and a surface upon which said housing is positioned; and wherein a respective said first plate is positionable on said housing such that said respective said first plate is configured for serving as the tabletop, wherein said plurality of bulbs is positioned on said housing such that said plurality of bulbs is configured for illuminating the area proximate to said housing.

* * * * *